US009057529B2

(12) United States Patent
Chiu

(10) Patent No.: US 9,057,529 B2
(45) Date of Patent: Jun. 16, 2015

(54) ROTATABLE EXHAUSTING STRUCTURE OF A PORTABLE AIR CONDITIONER

(75) Inventor: Ming-Tsung Chiu, New Taipei (TW)

(73) Assignee: New Widetech Industries Co., Ltd., New Taipei (TW)

( * ) Notice: Subject to any disclaimer, the term of this patent is extended or adjusted under 35 U.S.C. 154(b) by 368 days.

(21) Appl. No.: 13/609,977

(22) Filed: Sep. 11, 2012

(65) Prior Publication Data

US 2014/0069543 A1 Mar. 13, 2014

(51) Int. Cl.
*F24F 1/02* (2011.01)

(52) U.S. Cl.
CPC ..... *F24F 1/025* (2013.01)

(58) Field of Classification Search
CPC ..... F16L 37/26; F16L 41/08; F24F 1/025; F24F 13/0209
USPC ..... 285/325, 405; 62/410
See application file for complete search history.

(56) References Cited

U.S. PATENT DOCUMENTS

| | | | | | |
|---|---|---|---|---|---|
| 958,043 | A * | 5/1910 | Stockley | 285/325 |
| 2,933,334 | A * | 4/1960 | De Moude | 285/110 |
| 3,583,731 | A * | 6/1971 | Jewell | 285/85 |
| 3,656,782 | A * | 4/1972 | Molino | 285/189 |
| 4,441,403 | A * | 4/1984 | Hansen | 454/182 |
| 6,195,910 | B1 * | 3/2001 | Robineau | 34/417 |
| D681,789 | S * | 5/2013 | Chiu | D23/333 |
| 2006/0111037 | A1 * | 5/2006 | Poirier et al. | 454/270 |
| 2013/0175796 | A1 * | 7/2013 | Ranta et al. | 285/81 |

* cited by examiner

*Primary Examiner* — James Hewitt
(74) *Attorney, Agent, or Firm* — C. G. Mersereau; Nikolai & Mersereau, P.A.

(57) ABSTRACT

A rotatable exhausting structure of a portable air conditioner has a housing and a connecting tube. The housing has through hole, and multiple holders and a resilient stop separately arranged around the through hole. The connecting tube has a flange formed on and around an outer surface of the connecting tube and held between the holders and the resilient stop of the housing, and is used to be connected to an exhausting pipe. Thus, the connecting tube is rotatable relative to the housing. When torque is caused in the exhausting pipe due to redirecting it, the connecting tube rotates accordingly. The exhausting pipe is not bent or twisted and keeps in good condition.

20 Claims, 7 Drawing Sheets

ROTATABLE EXHAUSTING STRUCTURE OF A PORTABLE AIR CONDITIONER

BACKGROUND OF THE INVENTION

1. Field of the Invention

The present invention relates to an exhausting structure, especially to an exhausting structure of a portable air conditioner that is rotatable.

2. Description of the Prior Art(s)

An air conditioner cools, heats, dehumidifies or filters indoor air for thermal comfort. A portable air conditioner is placed on a ground without requiring special adaptation to a window or a wall and is moved and stored conveniently at times when the weather is sufficiently comfortable to not require change. Therefore, the portable air conditioner has become popular.

With reference to FIG. 7, a conventional exhausting structure of a portable air conditioner comprises a housing 41 and a connecting tube 42. The housing 41 has an exhaust hole 411 and multiple retaining latches 412. The exhaust hole 411 is formed through the housing 41. The retaining latches 412 are separately formed on an outer surface of the housing 41 and are arranged around the exhaust hole 411. The connecting tube 42 is connected to the housing 41, and has a proximal end and multiple fastening holes 421. The proximal end of the connecting tube 42 corresponds to the exhaust hole 411 of the housing 41. The fastening holes 421 are separately formed through the connecting tube 42, are arranged around the proximal end of the connecting tube 42 and respectively engage the retaining latches 412. A distal end of the connecting tube 42 is further connected to an exhausting pipe 43. The exhausting pipe 43 is long and flexible. Thus, the portable air conditioner exhausts through the exhaust hole 411 of the housing 41 and the connecting tube 42, and then the exhausting pipe 43 guides exhaust air to outdoors.

The key feature of the air conditioner is that it is movable to different locations. However, directions in which the exhausting pipe 43 can extend vary according to the locations of the portable air conditioner. Since the housing 41 and the connecting tube 42 connect with each other via the retaining latches 412 and the fastening holes 421, the connecting tube 42 is unable to rotate relative to the housing 41 and thus cannot dissipate torque formed therein. Therefore, the only way to change the direction that the exhausting pipe 43 extends is bending and twisting the exhausting pipe 43, which causes damage to the exhausting pipe 43.

SUMMARY OF THE INVENTION

The main objective of the present invention is to provide a rotatable exhausting structure of a portable air conditioner. The rotatable exhausting structure has a housing and a connecting tube. The housing has through hole, and multiple holders and a resilient stop separately arranged around the through hole. The connecting tube has a flange formed on and around an outer surface of the connecting tube and held between the holders and the resilient stop of the housing, and is used to be connected to an exhausting pipe.

Thus, the connecting tube is rotatable relative to the housing. When torque is caused in the exhausting pipe due to redirecting it, the connecting tube rotates accordingly. The exhausting pipe is not bent or twisted and keeps in good condition.

DETAILED DESCRIPTION OF THE PREFERRED EMBODIMENTS

Figure 1:
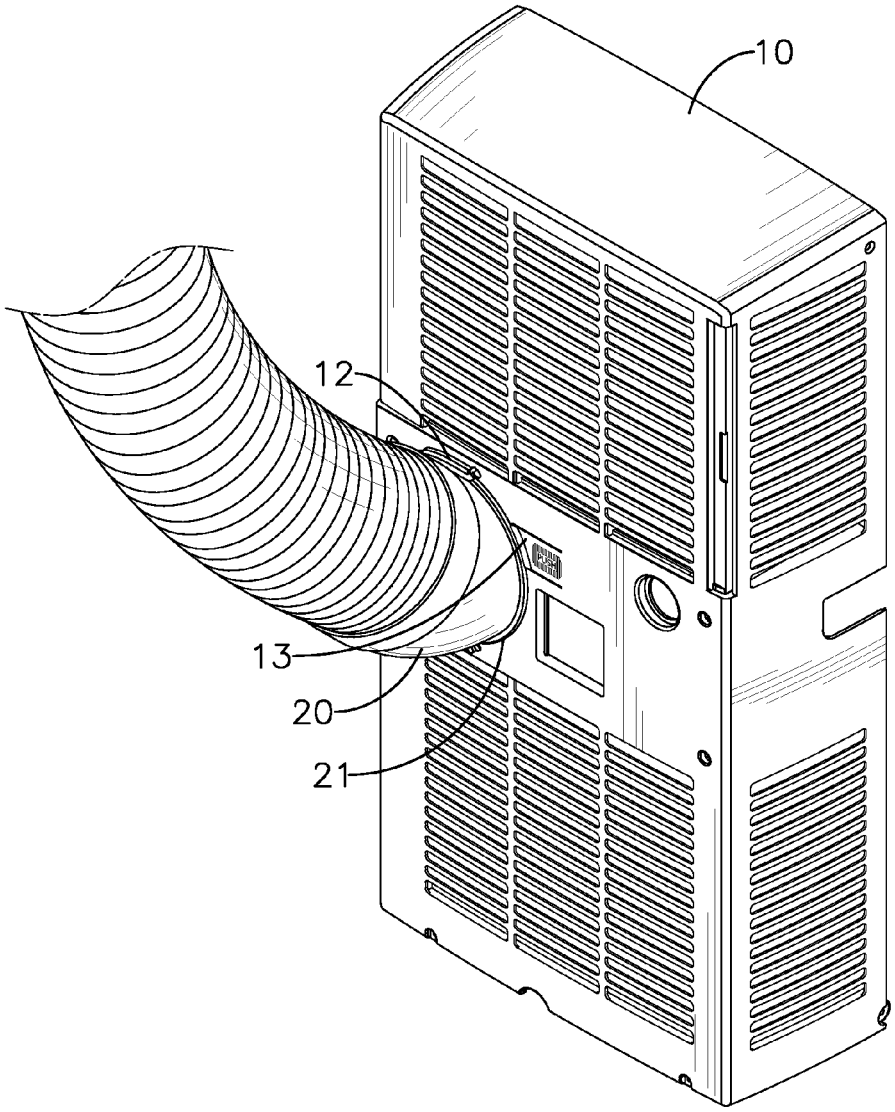
FIG. 1 is a perspective view of a first embodiment of a rotatable exhausting structure of a portable air conditioner in accordance with the present invention.

With reference to FIG. 1, a rotatable exhausting structure of a portable air conditioner in accordance with the present invention comprises a housing 10 and a connecting tube 20.

Figure 2:
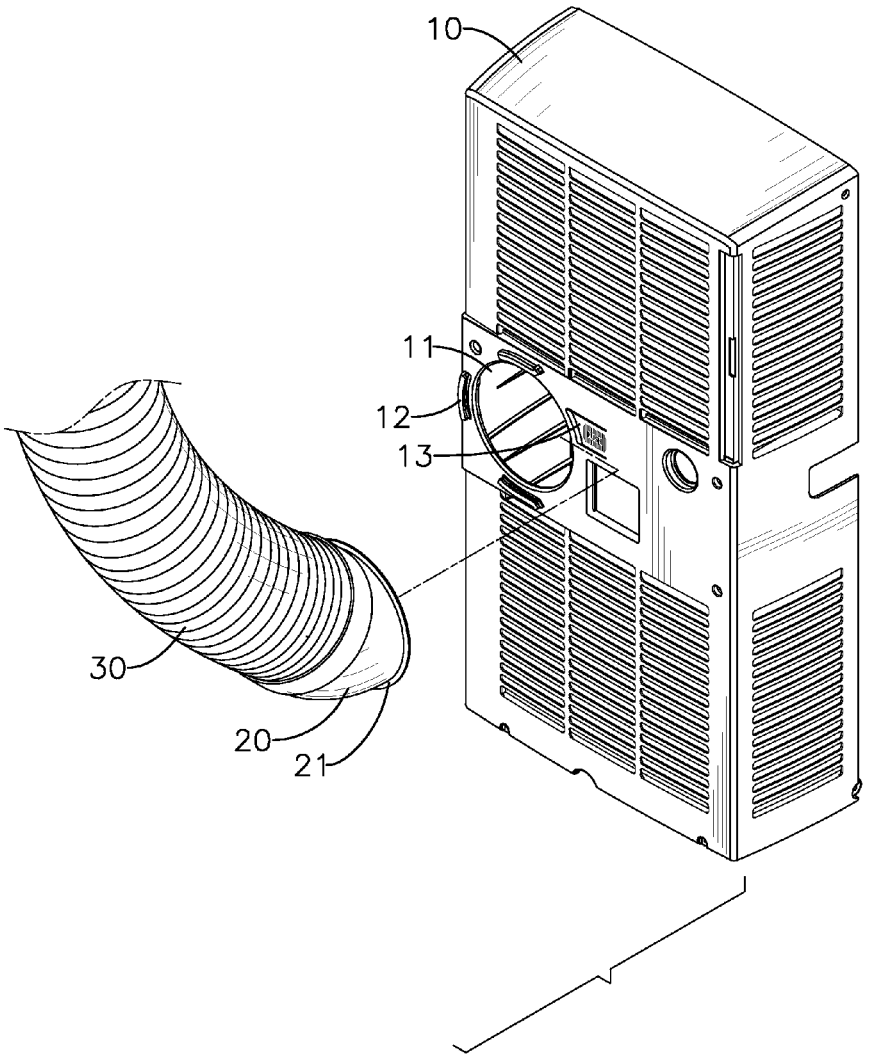
FIG. 2 is an exploded perspective view of the rotatable exhausting structure in FIG. 1.

With further reference to FIG. 2, the housing 10 is mounted on a back of the portable air conditioner and has an outer surface, a through hole 11, multiple positioning holders 12 and a resilient stop 13. The through hole 11 is formed through the housing 10 and is circular.

Figure 3:
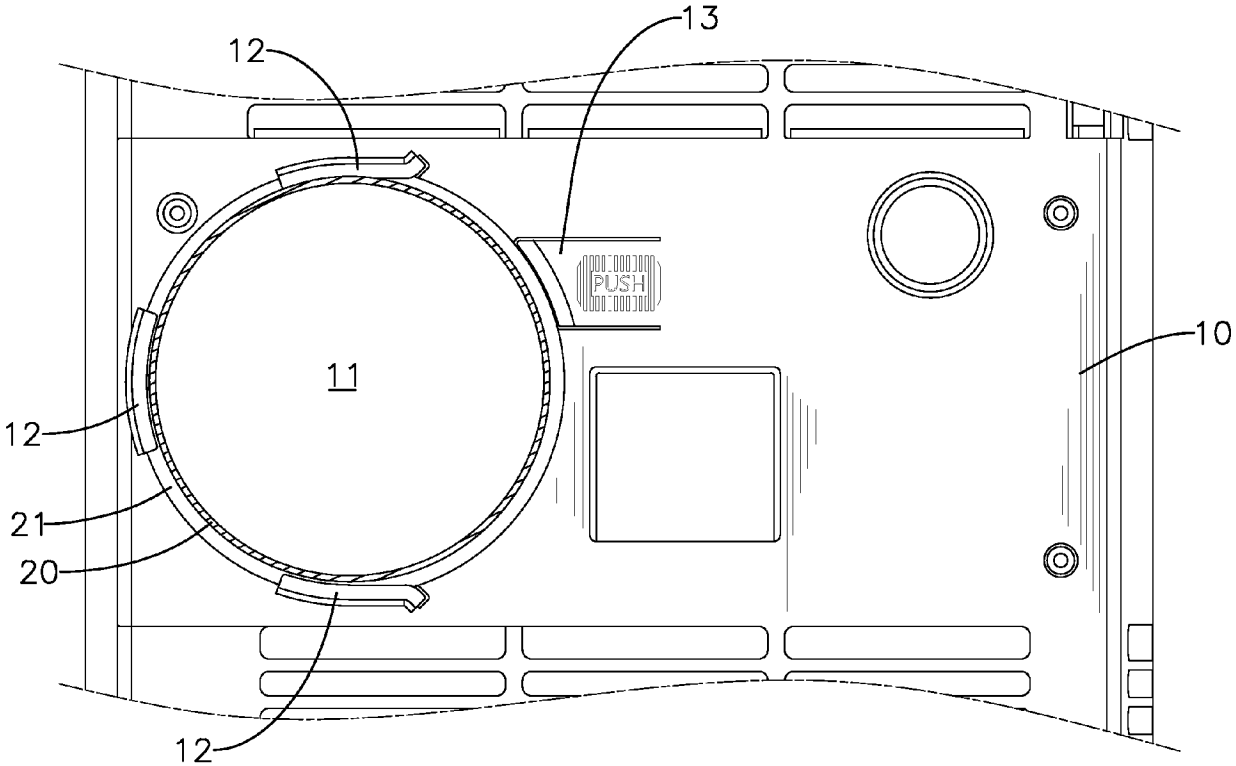
FIG. 3 is an enlarged cross-sectional front view of the rotatable exhausting structure in FIG. 1.

With further reference to FIG. 3, the positioning holders 12 are separately formed on the outer surface of the housing 10 and are arranged around the through hole 11. Each positioning holder 12 is elongated and arced, and has an inner surface, two opposite ends and an engaging recess 121. The inner surface of the positioning holder 12 is positioned toward the through hole 11. The engaging recess 121 of the positioning holder 12 is formed in the inner surface of the positioning holder 12 and is extended through the ends of the positioning holder 12.

Figure 4:
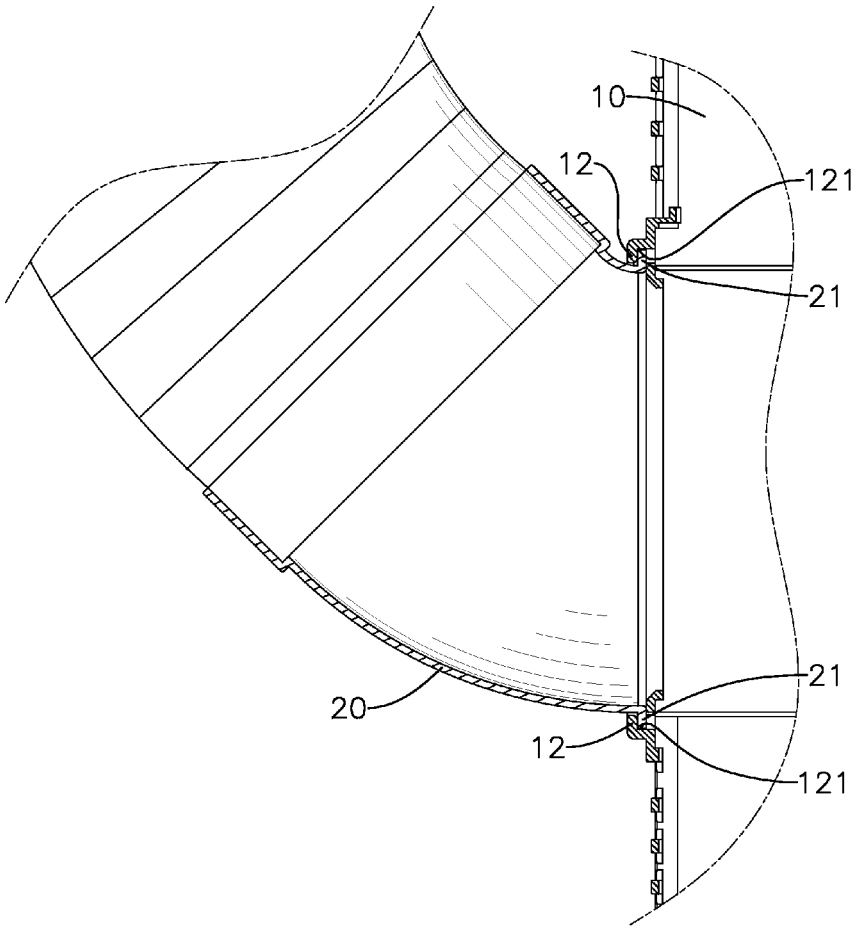
FIG. 4 is an enlarged cross-sectional side view of the rotatable exhausting structure in FIG. 1.
Figure 5:
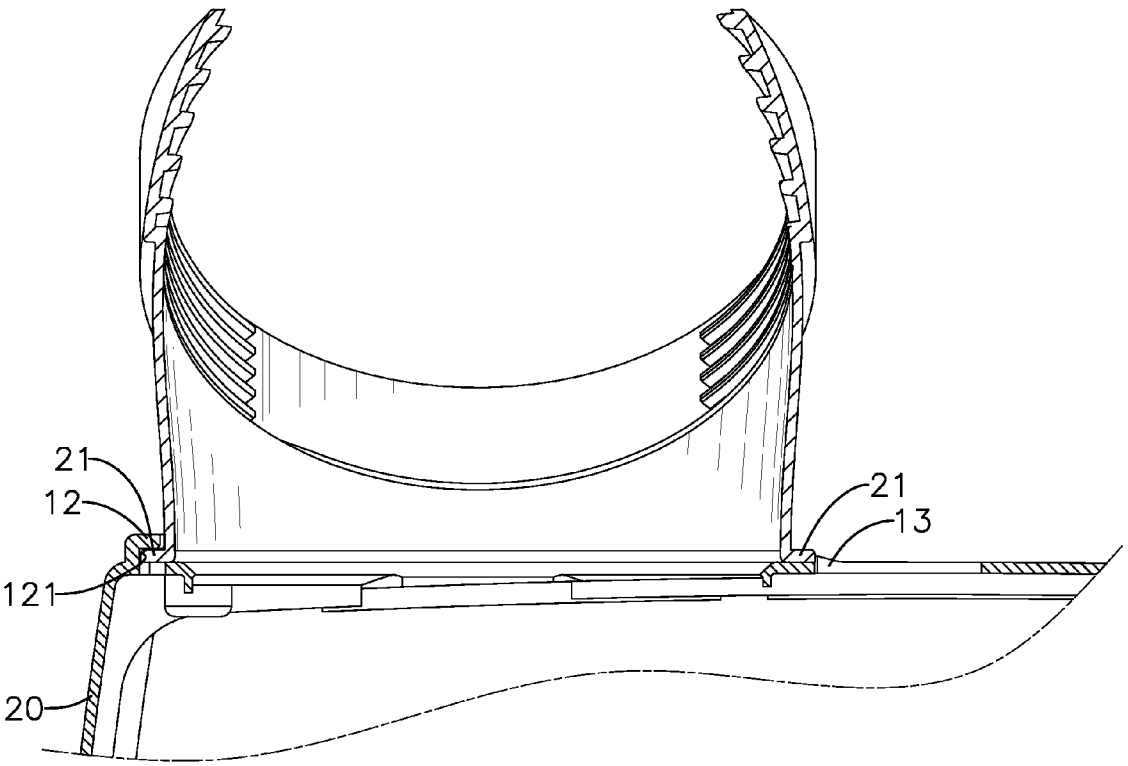
FIG. 5 is an enlarged cross-sectional top view of the rotatable exhausting structure in FIG. 1.

With further reference to FIG. 4, the resilient stop 13 is formed on the outer surface of the housing 10, is disposed by the through hole 11 and between two of the positioning holders 12, and has a proximal end and a distal end. The proximal end of the resilient stop 13 is attached to the housing 10. The distal end of the resilient stop 13 is positioned toward the through hole 11 and protrudes outward from the outer surface of the housing 10.

The connecting tube 20 is curved, is circular in cross-section, is rotatably connectable to the housing 10 and has a proximal end, an outer surface and a flange 21. The proximal end of the connecting tube 20 corresponds in size and shape to the through hole 11 of the housing 10. The flange 21 is formed on the outer surface of the connecting tube 20, is disposed around the proximal end of the connecting tube 20, is mountable in the engaging recesses 121 of the positioning holders 12 of the housing 10, abuts the resilient stop 13 of the housing 10. Thus, the flange 21 is securable in the engaging recesses 121 of the positioning holders 12.

A distal end of the connecting tube 20 is further connected to an exhausting pipe 30. The exhausting pipe 30 is long and flexible, and may be a corrugated pipe.

With reference to FIG. 3, in a first preferred embodiment, the housing 10 has three positioning holders 12 and one resilient stop 13. The positioning holders 12 and the resilient stop 13 are separately arranged around the through hole 11 of the housing 10. The three positioning holders 12 are spaced out 90 degrees apart.

Figure 6:
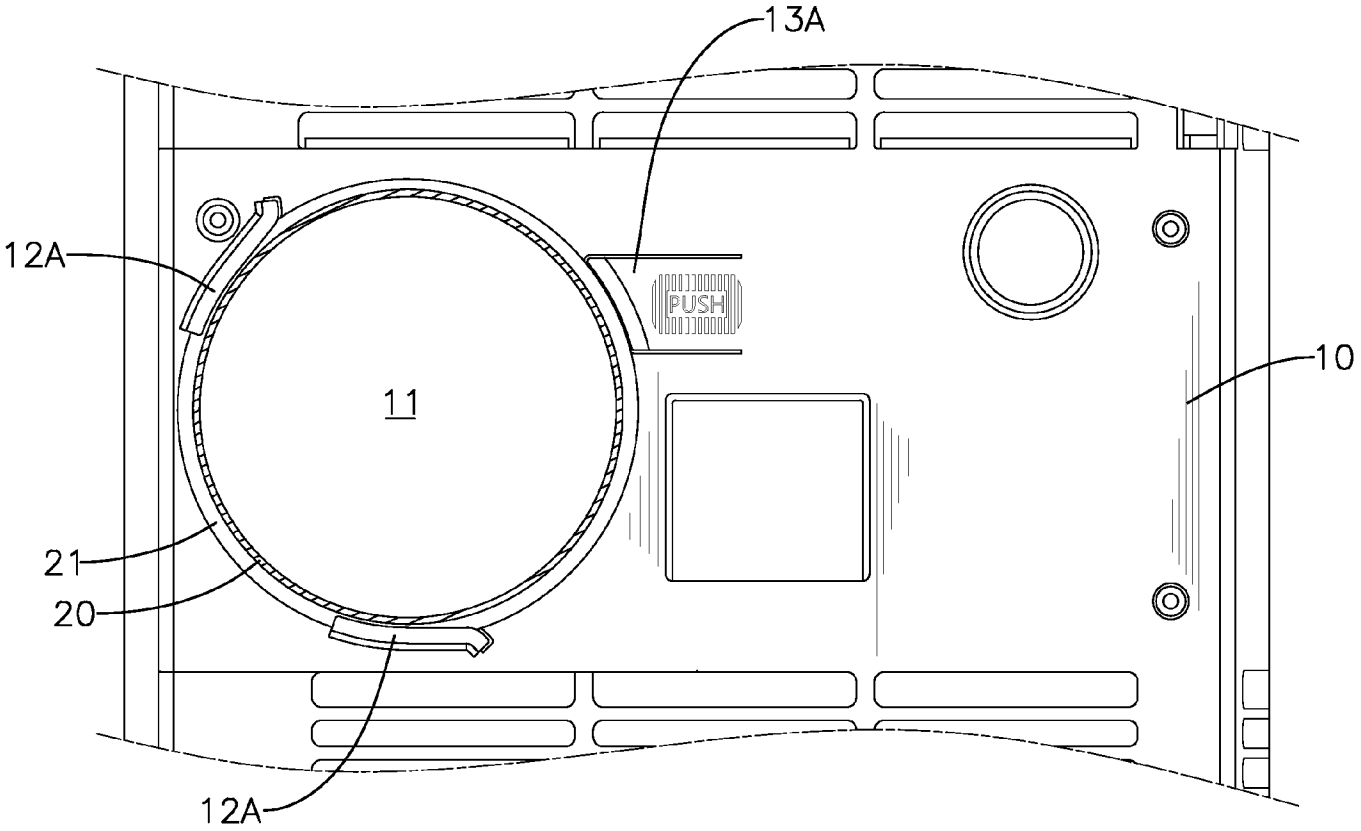
FIG. 6 is an enlarged cross-sectional front view of a second embodiment of a rotatable exhausting structure of a portable air conditioner in accordance with the present invention.
Figure 7:
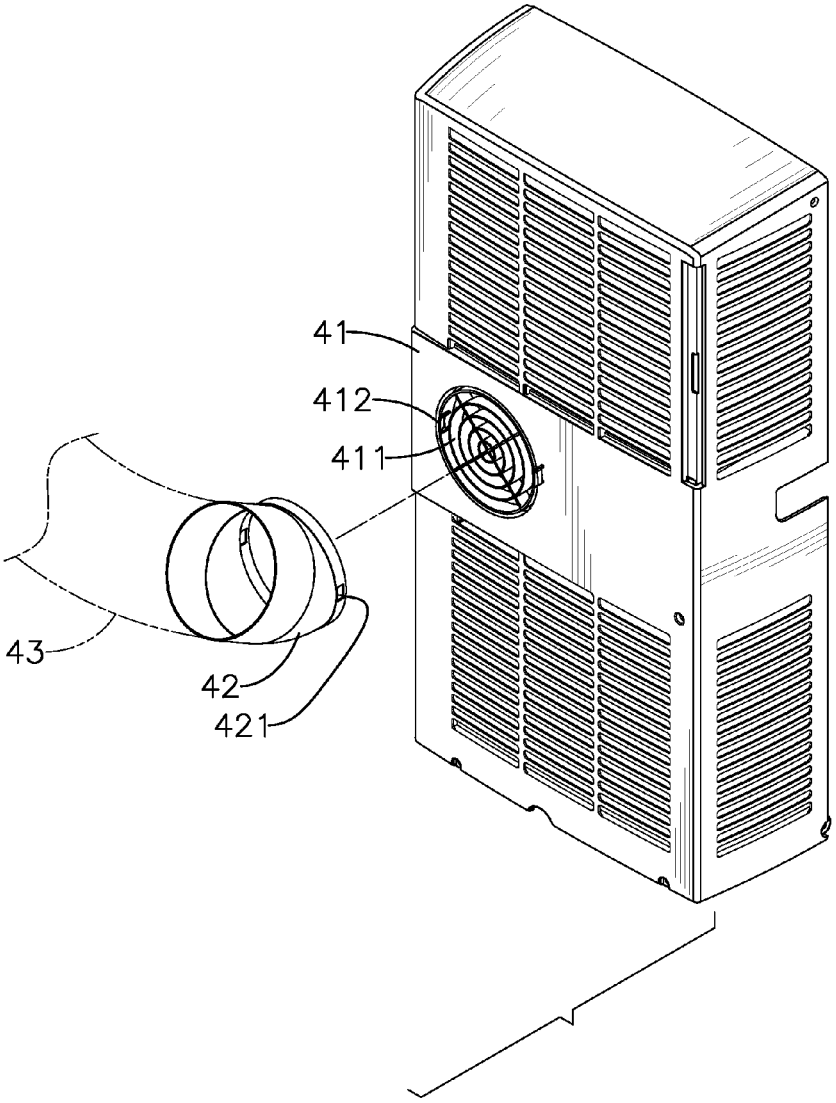
FIG.7 PRIOR ART
FIG. 7 is an exploded perspective view of a conventional exhausting structure of a portable air conditioner in accordance with the prior art.

With reference to FIG. 6, in a second preferred embodiment, the housing 10 has two positioning holders 12A and one resilient stop 13A. The positioning holders 12A and the resilient stop 13A are separately arranged around the through hole 11 of the housing 10. The two positioning holders 12A are spaced out 120 degrees apart.

When mounting the connecting tube 20 onto the housing 10, the proximal end of the connecting tube 20 slides over the resilient stop 13 and the flange 21 of the connecting tube 20 presses the resilient stop 13. When the flange 21 enters the engaging recesses 121 of the positioning holders 12, the resilient stop 13 returns to its pre-pushed position whereby it abuts an outer periphery of the flange 21 of the connecting tube 20. Thus, the connecting tube 20 is held between the positioning holders 12 and the resilient stop 13.

When the air conditioner it not required, the connecting tube can be released from the housing 10 by a user first pressing the resilient stop 13 toward the housing 10 and away from the outer periphery of the flange 21 and sliding the proximal end of the connecting tube 20 past the resilient stop 13, whereby the flange 21 disengages from the engaging recesses 121 of the positioning holders 12.

The rotatable exhausting structure of the portable air conditioner as described has the following advantages. When the flange 21 of the connecting 20 is mounted in the engaging recesses 121 of the positioning holders 12 of the housing 10, the connecting tube 20 is rotatable relative to the housing 10. Thus, when torque is caused in the exhausting pipe 30 due to redirecting it, the connecting tube 20 rotates accordingly. The exhausting pipe 30 is not bent or twisted and keeps in good condition. Furthermore, the connecting tube 20 can be easily and quickly disconnected from the body 10 to facilitate moving of the apparatus from one place to another.

What is claimed is:

1. A rotatable exhausting structure of a portable air conditioner comprising:

a housing having:

a through hole formed through the housing;

multiple positioning holders separately formed on an outer surface of the housing and arranged around the through hole, and each positioning holder being elongated and having:

an inner surface positioned toward the through hole; and an engaging recess formed in the inner surface of the positioning holder and extended through two opposite ends of the positioning holder; and a resilient stop formed on the outer surface of the housing, disposed by the through hole and between two of the positioning holders, and having:

a proximal end attached to the housing; and a distal end positioned toward the through hole and protruding outward from the outer surface of the housing; and a connecting tube rotatably connectable to the housing and having:

a proximal end corresponding in size and shape to the through hole of the housing; and a flange formed on an outer surface of the connecting tube, disposed around the proximal end of the connecting tube, being mountable in the engaging recesses of the positioning holders of the housing, and abutting the resilient stop of the housing.

2. The rotatable exhausting structure as claimed in claim 1, wherein the multiple positioning holders include three positioning holders, and the three positioning holders and the resilient stop are separately arranged around the through hole of the housing.

3. The rotatable exhausting structure as claimed in claim 2, wherein the three positioning holders are spaced out 90 degrees apart.

4. The rotatable exhausting structure as claimed in claim 1, wherein the multiple positioning holders include two positioning holders, and the two positioning holders and the resilient stop are separately arranged around the through hole of the housing.

5. The rotatable exhausting structure as claimed in claim 4, wherein the two positioning holders are spaced out 120 degrees apart.

6. The rotatable exhausting structure as claimed in claim 1, wherein the through hole of the housing is circular; and the connecting tube is circular in cross-section.

7. The rotatable exhausting structure as claimed in claim 2, wherein the through hole of the housing is circular; and the connecting tube is circular in cross-section.

8. The rotatable exhausting structure as claimed in claim 3, wherein the through hole of the housing is circular; and the connecting tube is circular in cross-section.

9. The rotatable exhausting structure as claimed in claim 4, wherein the through hole of the housing is circular; and the connecting tube is circular in cross-section.

10. The rotatable exhausting structure as claimed in claim 5, wherein the through hole of the housing is circular; and the connecting tube is circular in cross-section.

11. The rotatable exhausting structure as claimed in claim 1, wherein the connecting tube is curved.

12. The rotatable exhausting structure as claimed in claim 2, wherein the connecting tube is curved.

13. The rotatable exhausting structure as claimed in claim 3, wherein the connecting tube is curved.

14. The rotatable exhausting structure as claimed in claim 4, wherein the connecting tube is curved.

15. The rotatable exhausting structure as claimed in claim 5, wherein the connecting tube is curved.

16. The rotatable exhausting structure as claimed in claim 6, wherein the connecting tube is curved.

17. The rotatable exhausting structure as claimed in claim 7, wherein the connecting tube is curved.

18. The rotatable exhausting structure as claimed in claim 8, wherein the connecting tube is curved.

19. The rotatable exhausting structure as claimed in claim 9, wherein the connecting tube is curved.

20. The rotatable exhausting structure as claimed in claim 10, wherein the connecting tube is curved.

* * * * *